United States Patent [19]

Pinto et al.

[11] Patent Number: 4,887,070

[45] Date of Patent: Dec. 12, 1989

[54] APPARATUS FOR PROTECTING PERSONS ENTERING THE ZONE OF DANGER OF POWER-OPERATED TEXTILE MACHINES

[75] Inventors: Akiva Pinto, Duesseldorf; Guenter Lucassen, Haltern; Reinhard Schmidt, Gescher, all of Fed. Rep. of Germany

[73] Assignee: Hergeth Hollingsworth GmbH, Duelman, Fed. Rep. of Germany

[21] Appl. No.: 246,465

[22] Filed: Sep. 19, 1988

[30] Foreign Application Priority Data

Oct. 8, 1987 [DE] Fed. Rep. of Germany ..... 3733972

[51] Int. Cl.[4] ..... G08B 13/26

[52] U.S. Cl. ..... 340/561

[58] Field of Search ..... 340/561, 573, 686, 679, 340/551; 361/179, 461, 420, 474.2

[56] References Cited

U.S. PATENT DOCUMENTS

| | | | |
|---|---|---|---|
| 4,232,286 | 11/1980 | Voll | 324/207 |
| 4,280,580 | 7/1981 | Wojcik | 246/187 |
| 4,661,797 | 4/1987 | Schmall | 340/561 |
| 4,757,450 | 7/1988 | Etoh | 364/461 |
| 4,802,096 | 1/1989 | Hainsworth et al. | 318/587 |

FOREIGN PATENT DOCUMENTS

| | | | |
|---|---|---|---|
| 2850421 | 5/1980 | Fed. Rep. of Germany | 901/49 |

*Primary Examiner*—Reinhard J. Eisenzopf
*Assistant Examiner*—Maura K. Regan
*Attorney, Agent, or Firm*—Cort Flint

[57] ABSTRACT

A sensor (14) is carried by a moving element (7) which may be a cantilevered arm of a textile fiber opening machine (1) having a movable tower (2) on which cantilevered arm (7) is carried. Sensor (14) includes a bar in which an electrical current generated from (17) and sensed by (18) is conducted to set up an electromagnetic field around the moving element in a danger zone. Changes in the field caused by intrusion of the zone by a person are detected to cut off machine operation.

9 Claims, 2 Drawing Sheets

APPARATUS FOR PROTECTING PERSONS ENTERING THE ZONE OF DANGER OF POWER-OPERATED TEXTILE MACHINES

BACKGROUND OF THE INVENTION

The invention relates to an apparatus for protecting persons entering a zone of danger of power-operated textile machines, in particular, of devices for opening bales of spinning fiber material, e.g. cotton, by reducing means, e.g. milling devices, etc.

It is common practice that moving elements, in particular driving units of machinery including textile machines, have been protected against undue approaches of any kind. Since driving elements with movable parts are mounted stationarily, a fixed casing will generally suffice for protection. The casing may be designed, so that the machine is automatically stopped if the casing is opened.

For the control and protection of walkable zones of danger in connection with power-operated textile machines, it is known to mount a transmitter and a receiver in a mutual space. Upon the interruption of a beam path between them by an intruder, a signal is initiated and used for the direct interruption of a possibly dangerous movement of the textile machine. It has been known to provide an interrupter in the form of a light barrier protection. Openers for textile fiber bales comprise moving fiber milling units having more than one zone of danger. The mutual spatial arrangement of transmitters and receivers may be divided to ensure that the zone of danger is completely enclosed by the beam path between transmitter and receiver for corresponding operating positions of the milling units. However, in practice, the subdivision of a light-beam barrier is often impractical. With the set-up of a new bale, the opposite safety barrier is often interrupted unintentionally, with a resultant standstill of the machine. A correction of the bale setup is only possible if the total operation is interrupted. For narrow space conditions, the zones of danger to be protected may be marked, but only with difficulty.

Accordingly, an object of the present invention is to reliably operate a safety sensor for power-operated textile machines and restrict its action to a sphere necessary for protection.

SUMMARY OF THE INVENTION

The invention is characterized by at least one safety sensor at which an electromagnetic field is generated near a power-operated member of a textile machines. The sensor is connected to a monitoring and control device generating the electromagnetic field which is responsive to a change in the filed. The safety sensor may be provided in a zone of danger of a movable element of the machine. The zone in which a danger is signalled is restricted to an area directly surrounding the machine element causing the danger. The other, undangerous zones may be left free of any sensor. This is generally sufficient for excluding danger at the textile machine. It is not necessary to mark substantially large zones of danger because the effect would be only reliable if sufficient space is available around the machine. This is particularly applicable to the situation in which doors are to be secured against unintentional or unauthorized opening, and also to machine elements which are reciprocated over a predetermined path for the performance of the work. Due to a restriction of the zone of danger to around the moving element itself, a larger space, still close to the machine, is freely available and may be utilized for other work contributing to the machine's increased output. The movable machine element is protected against a danger of an accident, while the other regions at or around the machine are fully walkable by an attendant without any risk. Further, the machine may be freely accessible in operation and its functional performance remains fully controllable.

Preferably, the sensor is a bar or tube around the moving element comprising an electric conductor traversed by current. The electrically insulated, bar-shaped sensor is fixed to the machine or to the respective machine element near the danger zone. The bar-shaped sensor is easily detectable and readily visible for anybody operating the machine. As a resultant psychological effect, third parties are directly warned to be careful in the vicinity of particular machine elements.

The fiber opening means may be in the form of a tower movable along a row of bales and comprising a cantilevered arm containing the reducing elements. According to another feature of the invention, the opener is provided with a rod-shaped sensor which extends along the free sides of the cantilevered arm. The danger zone of the machine and the safe distance to be observed by anybody are clearly obvious. Moreover, doors or flaps at the machine housing may be protected this way against arbitrary opening.

If machine elements to be protected have to be moved under special conditions, e.g. to inspect the interior etc., the bar-shaped sensor may be interrupted. The points of interruption may be bridged by a flexible connection for the electric lines. For instance, this may be applicable if the bar-shaped sensor is provided along an end of the cantilevered arm of the opening means.

Monitoring and control means for the sensor may be accommodated directly in the housing of the moving machine element, e.g. of the tower or cantilevered arm of the opening means. Thus, no additional cables, feed and discharge lines must be provided which have to be covered and which involve a risk of stumbling thereover.

DESCRIPTION OF THE DRAWINGS

The construction designed to carry out the invention will hereinafter be described, together with other features thereof.

The invention will be more readily understood from a reading of the following specification and by reference to the accompanying drawings forming a part thereof, wherein an example of the invention is shown and wherein.

DESCRIPTION OF A PREFERRED EMBODIMENT

Figure 1:
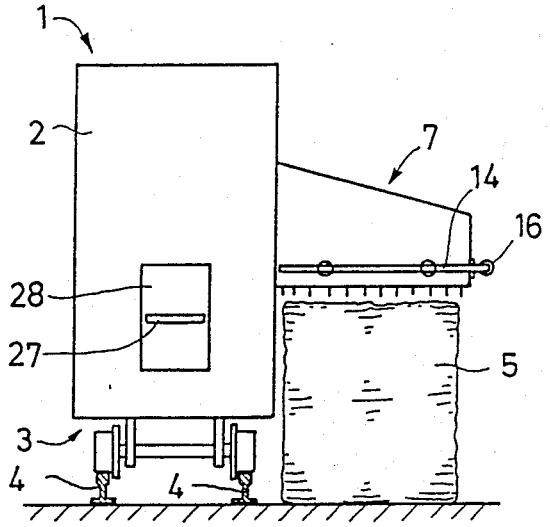
FIG. 1 is a schematic elevational view of one embodiment of the invention used with a bale opening machine having a reciprocating tower.
Figure 2:
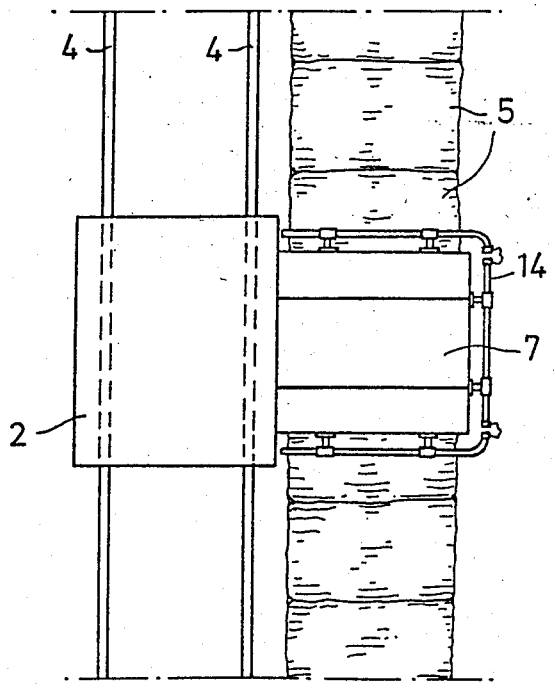
FIG. 2 is a plan view of the device of FIG. 1.
Figure 3:
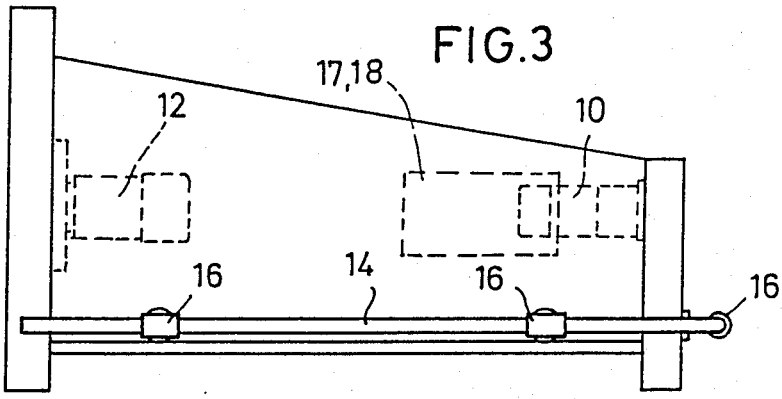
FIGS. 3, 4, and 5 are a side view, a plan view, and a front view, scaled up, of a cantilevered arm including a circulating reducing elements of a bale opening machine having a safety sensor according to the invention.

Referring now in more detail to the drawings, a bale opening means, designated generally as 1, comprises a tower 2 on an undercarriage 3 adapted to reciprocate on rails 4 along a row of bales.

One or both sides of tower 2 are provided with a cantilevered arm 7 accommodating the reducing elements, preferably milling rollers 8, 9 driven by motor 10 via transmission belt 11. When the bale row 5 is reduced, cantilevered arm 7 together with tower 2 is reciprocated along rails 4. As the bale row is reduced, cantilevered arm 7 is displaced downwardly in height at the tower 2 by motor 12.

A zone of danger of bale opening means 1 is produced by moving cantilevered arm 7 including the milling rollers 8, 9. The underside of cantilevered arm 7 is open to enable milling rollers to freely reduce the upper bale row surface. To protect persons entering the zone of danger, a safety sensor 14 is provided in the form of a bar or tube. A current-traversed electric conductor is included inside the bar or tube which generates an electromagnetic field which extends in a plane transverse to the conductor or sensor axis. Bar-shaped or tubular sensor 14 extends around housing 15 of cantilevered arm 7. Sensor 14 is supported by insulating holders 16 which are fitted at suitable points to housing 15. A device 17 for generating the electromagnetic field and a device 18 which responds to a change of said field, are housed in box 19 disposed within housing 15. Devices 17 and 18 receive electric supply 20 from a terminal and switch box 21. Sensor 14 is in electric communication with devices 17 and 18 via electric lines 23, 24.

As to its spatial pattern, the generated electromagnetic field may be controlled to provide a change of a circular or cylindrical shape. This may be achieved by a shield insulatedly spaced from the sensor and preferably being a grounded electric conductor. In the instant case, the iron mass of the cantilevered arm complies with such conditions providing a resultant generally pear-shaped electric field having an elongated transverse plane extending away from cantilevered arm 7. The reach of the electromagnetic field is increased. The electromagnetic field is influenced and changed by a person approaching the cantilevered arm within the field. The change is constantly monitored by device 18. With the use of a corresponding control unit 27, the driving motor 10 for the milling rollers 12 and for the movement of the cantilevered arm, and, if necessary, of the tower to which it is fixed, is disconnected in response to a change of the electric field. A door 28 or the like at the tower 2 or at another housing of the opening means may be protected in a similar way by a rod shaped sensor 17.

Figure 4:
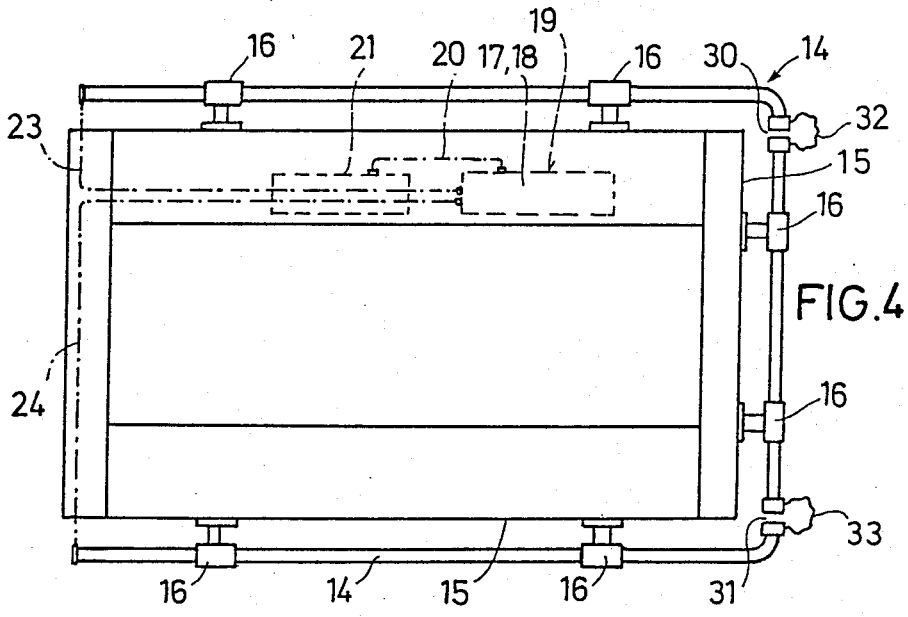
Figure 5:
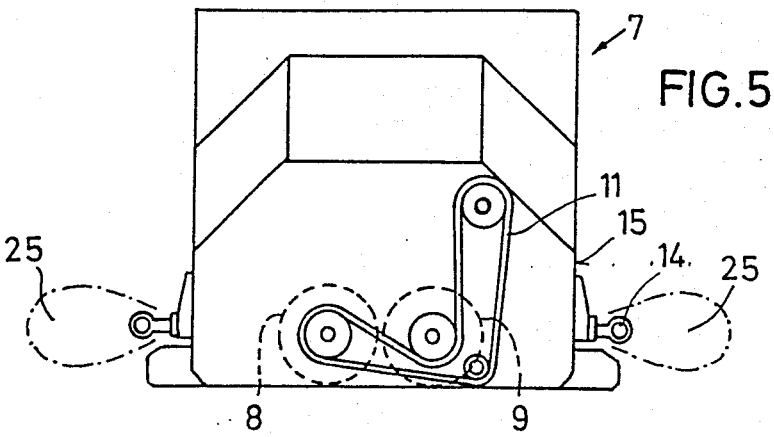

Other elements of the opening means may be protected similarly against an unwanted approach of persons, e.g. in that the sensor is arranged at a convenient point of the tower or conducted therearound. When sensor 14 is extended along housing parts to be opened, rod-shaped sensor 14 may be interrupted. Such interruptions are provided at points 30 and 31 of FIG. 4. In this case, the respective opposite ends of the sensor are electrically interconnected by bridging lines 32 and 33. The field of danger may be confined while persons may be present in the larger, general vicinity of the opener.

While a preferred embodiment of the invention has been described using specific terms, such description is for illustrative purposes only, and it is to be understood that changes and variations may be made without departing from the spirit or scope of the following claims.

What is claimed is:

1. Apparatus for protecting persons entering a zone of danger in proximity to power-operated textile machines such as textile fiber bale opening machines having movable fiber reducing means and the like said machine consisting of a fiber opening means having a tower movable along a bale row, a cantilevered arm which carries said reducing means, and said sensor mean including a bar-shaped conductor carried about free sides of said cantilevered arm through which an electrical current is conducted to set up said field characterized by at least one safety sensor disposed near and around said an element of said power operated machine to be protected, means for generating an electromagnetic field in connection with said sensor, and a monitoring and control means connected to said sensor responsive to a change in said electromagnetic field caused by the presence of a person in said zone of danger.

2. The apparatus of claim 1 wherein said sensor includes a bar-shaped conductor through which a current is conducted, and insulation means for securing said bar-shaped conductor to said moving element of said machine in the area of said danger zone.

3. The apparatus of claim 1 wherein said means for generating said electromagnetic field, and said monitoring and control means for said sensor are disposed within a housing of said cantilevered arm.

4. The apparatus of claim 3 wherein said bar-shaped conductor is separated at predetermined locations to form discontinuous sections, and said discontinuous sections are bridged by a flexible electric connection at said locations.

5. The apparatus of claim 2 wherein said bar-shaped conductor is separated at predetermined locations to form discontinuous sections, and said discontinuous sections are bridged by a flexible electric connection at said locations.

6. In a textile apparatus having a moving machine element which creates a zone of danger to a person entering said zone near said moving element, the combination comprising means carried by said moving element for generating an electromagnetic field in said zone of danger, means for monitoring a change in said electromagnetic field due to the presence of a person within said zone of danger, and means for controlling said moving element in response to said monitoring means to terminate operation of said moving element in the event said monitoring means detects said change in said electromagnetic field and hence the presence of said person in said zone of danger and said means for generating said electromagnetic field comprises elongated conductor means carried by said moving elements which comprises discontinuous conductor sections, said discontinuous sections being bridged by flexible electrical connections.

7. In textile apparatus, the combination comprising a fiber opening machine having a tower which is movable along a bale row, a cantilevered arm carried by said tower; a bale reducing means carried by said cantilevered arm, sensor means carried by said cantilevered arm for detecting the presence of a person within a zone of danger of said moving cantilevered arm; and control means responsive to said sensor means for terminating operation of said cantilevered arm if the presence of a person is detected within said zone of danger by said sensor means.

8. The apparatus of claim 7 wherein said sensor means comprises elongated conductor means carried by said cantilevered arm for generating an electromagnetic field about said cantilevered arm in said zone of danger.

9. The apparatus of claim 8 wherein said elongated conductor means includes discontinuous sections carried by said cantilevered arm, and flexible electrical connectors connecting said discotinous sections of said conductor.

* * * * *